US005297595A

United States Patent [19]

Haile et al.

[11] Patent Number: 5,297,595

[45] Date of Patent: Mar. 29, 1994

[54] APPARATUS FOR INTRODUCING VOLATILE FUEL INTO A STORAGE TANK

[75] Inventors: Clay Haile, Farmington Hills; Ram D. Bedi, Birmingham, both of Mich.

[73] Assignee: K. J. Manufacturing Company, Wixom, Mich.

[21] Appl. No.: 30,831

[22] Filed: Mar. 12, 1993

[51] Int. Cl.[5] ..... B65D 43/16

[52] U.S. Cl. ..... 141/59; 141/44; 141/301; 220/DIG. 33; 220/86.2; 137/589

[58] Field of Search ..... 220/DIG. 33, 86.2, 89.1, 220/336; 215/236; 141/59, 44–46, 301, 312, 392; 137/587–589

[56] References Cited

U.S. PATENT DOCUMENTS

| | | | |
|---|---|---|---|
| 3,911,973 | 10/1975 | Casteline, Jr. | 141/59 |
| 4,199,012 | 4/1980 | Lasater | 141/59 X |
| 4,254,888 | 3/1981 | Chandler | 220/DIG. 33 |
| 4,557,302 | 12/1985 | Sunderhaus | 141/207 |
| 4,651,889 | 3/1987 | Uranishi et al. | 220/86.2 X |
| 4,762,247 | 8/1988 | Temmesfeld | 220/DIG. 33 X |
| 4,768,566 | 9/1988 | Ito et al. | 141/46 |
| 4,813,453 | 3/1989 | Jenkins et al. | 137/588 |
| 4,881,578 | 11/1989 | Rich et al. | 141/44 |
| 4,986,439 | 1/1991 | Ott et al. | 220/DIG. 33 X |
| 5,062,541 | 11/1991 | Galbo | 220/DIG. 33 X |
| 5,195,566 | 3/1993 | Ott et al. | 141/312 |

*Primary Examiner*—Ernest G. Cusick
*Attorney, Agent, or Firm*—Basile and Hanlon

[57] ABSTRACT

An apparatus for introducing fuel having a volatile hydrocarbon component into an on-board fuel storage tank of an automotive vehicle with reduced discharge of fuel vapors into the surrounding atmosphere, the apparatus including a fuel filler cap having at least one centrally positioned aperture extending therethrough through which a suitably configured fuel directing nozzle can pass. The fuel directing nozzle includes a vapor conveying line located in the interior of the nozzle capable of being brought into fluid communication with a vapor collection chamber located in the fuel filler cap such that, when engaged, a circuit is completed, fuel can be introduced into the on-board fuel storage tank of the automotive vehicle and any fuel vapors generated or displaced during the operation can be returned to the remote storage site or another suitable vapor collection facility remote from the automotive vehicle without contacting the surrounding environment.

17 Claims, 5 Drawing Sheets

APPARATUS FOR INTRODUCING VOLATILE FUEL INTO A STORAGE TANK

BACKGROUND OF THE INVENTION

1. Field of the Invention

The present invention relates to method and devices for introducing volatile fuel materials into an on-board fuel storage tank of an automotive vehicle in a safe and efficient manner. More particularly, the present invention pertains to methods and devices for introducing volatile fuels such as gasoline into an automotive vehicle in an environmentally safe manner which permits little or no discharge of hydrocarbon vapor or emissions into the surrounding atmosphere.

2. Brief Discussion of Relevant Art

The introduction of fuel to the on-board storage tank of an automotive vehicle presents various concerns regarding environmental and user safety. Specific among these are concerns regarding spillage of liquid fuel outside of the on-board storage tank before or after refueling procedures, exposure of the individual performing the refueling operation to liquid fuel and/or fuel vapors, and introduction of hydrocarbon emissions into the atmosphere during the refueling operation.

Heretofore, great attention was focused on elimination of unwanted spillage of liquid fuel before, during and after the refueling operation. To overcome such problems, modern fuel pumping devices are equipped with various sensors and automatic shut-off devices which can prevent addition of fuel to an over-full on-board storage tank. Additionally, fuel filler nozzles are equipped with manually operable triggers which serve to regulate and control the flow of the major portion of the fuel during the refueling operation.

Such devices fail to address the significant problem of gaseous hydrocarbon emissions produced and discharged during the refueling operation. In recent years, scientists and the general public have come to appreciate the detrimental impact uncontrolled hydrocarbon emissions have had and will continue to have on the environment. Hydrocarbon emissions may adversely impact the global environment as a whole; while, on a more personal level, long term exposure to elevated levels of hydrocarbons such as those generated during refueling operations may contribute to increased risks for health hazards such as cancer and the like.

Many devices have been proposed to reduce or limit the emission of hydrocarbons from sources such as those generated during refueling operations. These efforts have been fostered and mandated by the promulgation of new, tougher standards for hydrocarbon emissions levels. Among the devices and methods proposed for reducing hydrocarbon emissions during refueling operations are the addition of hydrocarbon capture canisters to the filler line of each automotive vehicle. Such devices would capture hydrocarbons in an adsorbtive media such as activated carbon as the gaseous hydrocarbons are emitted to prevent their escape into the surrounding atmosphere. Carbon canisters such as those proposed would be costly additions to new vehicles. Furthermore, in order to accomplish the sought after reduction in total refueling-related hydrocarbon emissions, carbon canisters would also have to be added to existing vehicles as costly retrofits.

Unfortunately, such adsorptive canisters will not provide maximum reduction or elimination of hydrocarbon emissions. Adsorptive canisters will still permit a portion of the gaseous hydrocarbons to escape. Additionally, as the adsorbtive canisters become saturated, replacement will be required at further expense to the operator of the vehicle. Because appropriate and timely replacement of spent or saturated adsorbtive canisters would be necessary to achieve maximum reduction in hydrocarbon emissions, a great deal of the success of such a program would rely on operator compliance. It has been the general experience that operators are adverse to large expenditures related to environmental compliance. Therefore significant amounts of capital will have to be dedicated to "over-designing" such devices to prevent premature failure and to eliminate excessive need to replace the adsorbtive canisters. Even so, it is foreseeable that governmental resources will be required to ensure that the vehicles remain in compliance with emission standards through new emission testing and the like.

As an interim measure, in an attempt to avoid the cost and confusion of such retrofits, various modifications have been proposed in the design of the fuel dispensing nozzle employed at most commercial gas stations. Examples of such modifications include the addition of a cowl over the fuel dispensing nozzle. In one embodiment, the cowl has an outer edge designed to engage the surface body panel surrounding the fuel filler opening to prevent the escape of fuel vapors during refueling. Such cowl designs would not prevent the escape of significant quantities of the hydrocarbon vapors which accumulate in the cowl and are released when the fuel filler nozzle is disengaged. A second embodiment of the cowl device is a deformable disc-like flange attached to the fuel filler nozzle which is adapted to roughly fit in the body opening located in most passenger vehicles in which the fuel filler nozzle is located. This device does not trap a significant portion of the emitted fuel vapors. Its major purpose is to divert fuel vapors from the operator of the fuel pump and prevent the inhalation of these materials.

None of the systems which have been proposed addresses the problem of spillage prior to or immediately after the refueling operation. This is particularly true with regard to spillage of residual fuel contained in the fuel filler nozzle.

Thus it is desirable to provide a device which would significantly reduce the level of gaseous hydrocarbons released during the refueling of a variety of automotive vehicles. It is also desirable to provide a refueling process and device which can essentially eliminate all hydrocarbon emissions generated as a result of refueling operations.

It is also desirable to provide a process and device which integrates the vehicle to be refueled and the refueling station into an essentially closed system, rather than treating the refueling operation as the temporary connection of two isolated elements. It is also desirable to provide a device which can eliminate gaseous hydrocarbon emissions in an economical manner which is easy to maintain, and easy to employ on and with existing automotive equipment and in existing refueling systems.

SUMMARY OF THE INVENTION

The present invention is an apparatus and process for refueling an automotive vehicle having an on-board fuel storage tank in which the automotive vehicle and the refueling device are temporarily linked in an integrated manner thereby achieving a significant reduction in, if not the complete elimination of, volatile hydrocarbon emissions produced during refueling operations.

The hydrocarbon discharge abatement apparatus of the present invention includes means for dispensing fuel from a fuel storage site remote from the automotive vehicle into the on-board fuel storage tank of the automotive vehicle. The fuel dispensing means of the present invention comprises a fuel filler nozzle device releasably engageable with the fuel receiving opening of the automotive vehicle. The fuel filler nozzle device has a fuel directing conduit with means for regulating and interrupting the flow of fuel passing through the conduit. The fuel directing conduit of the fuel filler nozzle device has a fuel inlet orifice, an opposed fuel outlet orifice, and means for engaging the fuel inlet opening of the automotive vehicle to be refueled in a sealing manner thereby establishing fluid communication between the fuel filler nozzle device and the fuel filler line of the automotive vehicle. The fuel filler nozzle device is, itself, connected to a suitable remote fuel storage site by means of a suitable fuel conveying conduit or conduits. The conduit or conduits can include suitable pumps, metering devices, and the like to permit the dispensation of fuel.

The sealing engagement means of the present invention also has at least one vapor discharge outlet located therein which establishes a fluid communication channel between the fuel filler line of the automotive vehicle and a vapor-conveying conduit. The vapor-conveying conduit is in fluid communication with a suitable remote vapor collection site to which the fuel vapors produced or expelled during refueling operations may be safely removed. Suitable remote vapor collection sites include but are not limited to the remote fuel storage site itself.

The hydrocarbon discharge abatement device of the present invention also includes specifically configured means for receiving fuel into the on-board storage tank of the automotive vehicle. The fuel receiving means includes a specially configured fuel filler cap releasably and sealingly engageable in the fuel receiving opening of the automotive vehicle. The filler cap of the present invention has an essentially flat planar surface member oriented in a plane perpendicular to a longitudinal axis defined by the fuel filler line of the automotive vehicle when the cap is in sealing engagement therewith. The flat planar surface of the fuel filler cap has an inner face engageable with the inlet in the fuel filler line of the automotive vehicle, an opposed upper face, and at least one central aperture extending therethrough.

The fuel dispensing means of the present invention includes a suitable fuel directing nozzle device having a first fuel inlet end in fluid communication with a remote fuel storage site and a second fuel outlet end adapted to be insertingly received in the central aperture in the flat planar member of the fuel filler cap. The fuel directing nozzle is, preferably, a conduit having a body wall, an outer surface and an inner surface, with the inner surface defining a hollow conduit interior. The fuel directing nozzle of the present invention has a vapor receiving inlet located on the body wall at a point between the fuel inlet opening and the fuel outlet opening. The vapor receiving inlet extends from the outer surface to the inner surface. A first end of a vapor conveying line is connected to the vapor receiving conduit establishing fluid communication between the inlet and a suitable vapor collection means located remote from the automotive vehicle being refueled.

BRIEF DESCRIPTION OF THE DRAWING

To further illustrate the present invention, the following drawing is provided in which like reference numerals are employed for the various elements throughout the several figures and in which.

DETAILED DESCRIPTION OF THE PREFERRED EMBODIMENTS

The present invention is a method and apparatus for reducing and/or eliminating hydrocarbon emissions produced during refueling operations. In the disclosure of the present invention, the term "hydrocarbon emission" is defined as gaseous and/or liquid vapor material which is rich in the volatile or low boiling components such as those found in petroleum fuels such as gasoline, alcohol fuels, and the like. These volatile components include, but are not limited to, materials which are classically referred to as "hydrocarbons"; i.e. organic compounds containing hydrogen and carbon. As used herein, the term "hydrocarbon emissions" can also include other volatile organic and inorganic compounds. It is anticipated that the device and process of the present invention can successfully control the level of volatile emissions containing a variety of compounds.

The device of the present invention can be successfully employed in refueling operations on automotive vehicles. As used herein, the term "automotive vehicles" is defined to include any and all movable vehicles having on-board fuel tanks accessible through a fuel receiving opening in a fuel filler line to contain and provide an energy source for an on-board power plant such as an internal combustion engine which can be refueled at fixed refueling stations such as service stations and the like. Examples of "automotive vehicles" include, but are not limited to, passenger cars, trucks, busses, boats, heavy off-road equipment, and the like.

The term "refueling operation" as defined herein is the process whereby liquid fuel is transferred from a fuel storage site remote from the automotive vehicle into the on-board fuel storage tank of the vehicle. The remote storage site may be either an in-ground or above-ground storage facility such as would be found at a conventional service station, or a refueling vehicle such as is employed to refuel large numbers of fleet vehicles or heavy off-road construction machinery.

Figure 1:
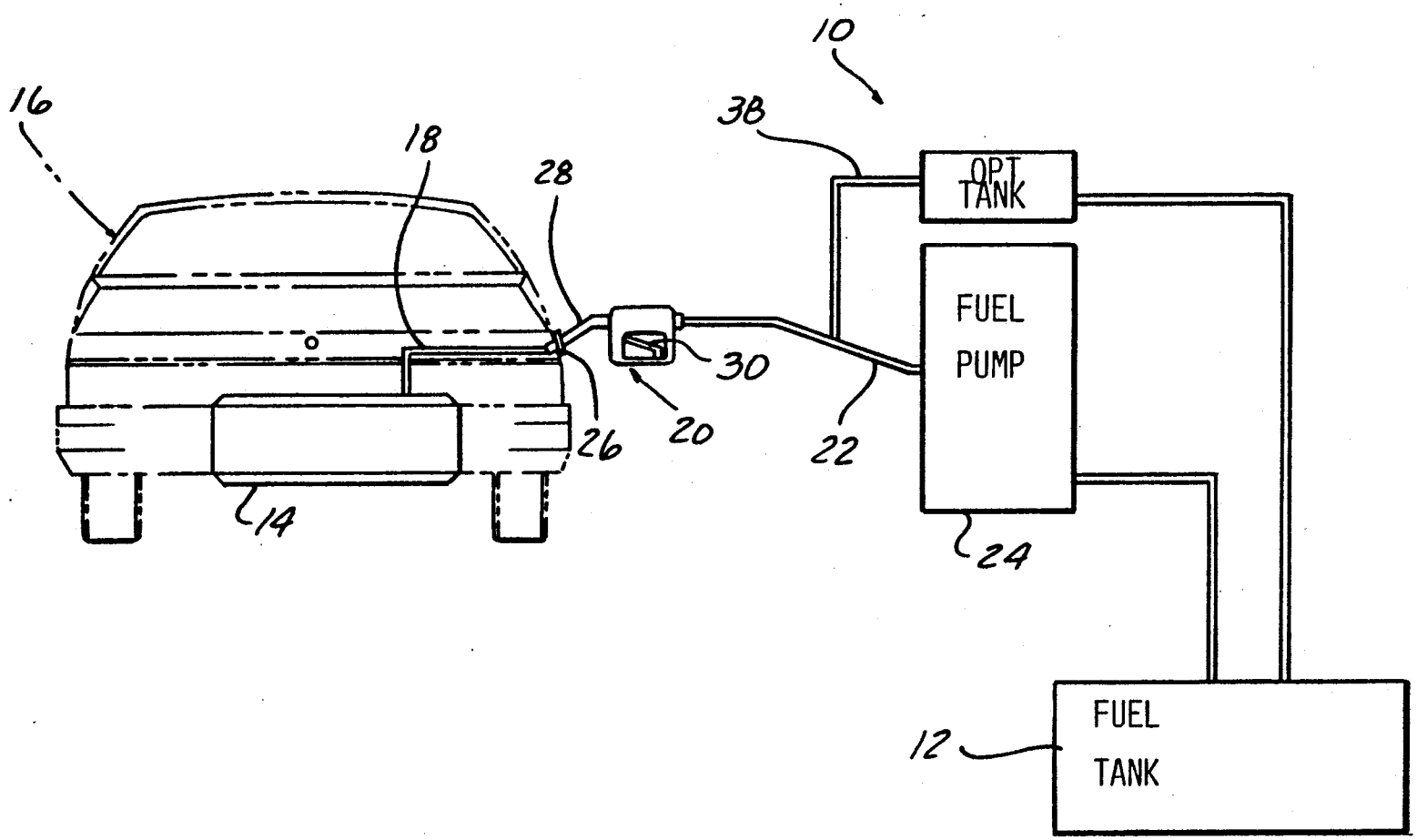
FIG. 1 is a schematic view of the self contained fuel filler system of the present invention.

As generally depicted in FIG.1, the device 10, of the present invention generally includes means for dispensing fuel from the remote fuel storage site 12 into the on-board fuel storage tank 14 of the automotive vehicle 16 and a device associatable with the fuel filler line 18 of the automotive vehicle 16 for collecting and directing fuel vapors produced during the refueling operation in an environmentally safe manner.

The fuel dispensing means which can be employed with the device 10 of the present invention includes a fuel filler nozzle device 20 in fluid communication with a flexible fuel hose 22 which is in communication with suitable means for pumping and measuring fuel such as fuel pump 24. The outlet end of the fuel filler nozzle device 20 is releasably engageable with a fuel receiving opening 26 in the fuel filler line 18 in fluid communication with the fuel tank 14 of the automotive vehicle 16.

Figure 2:
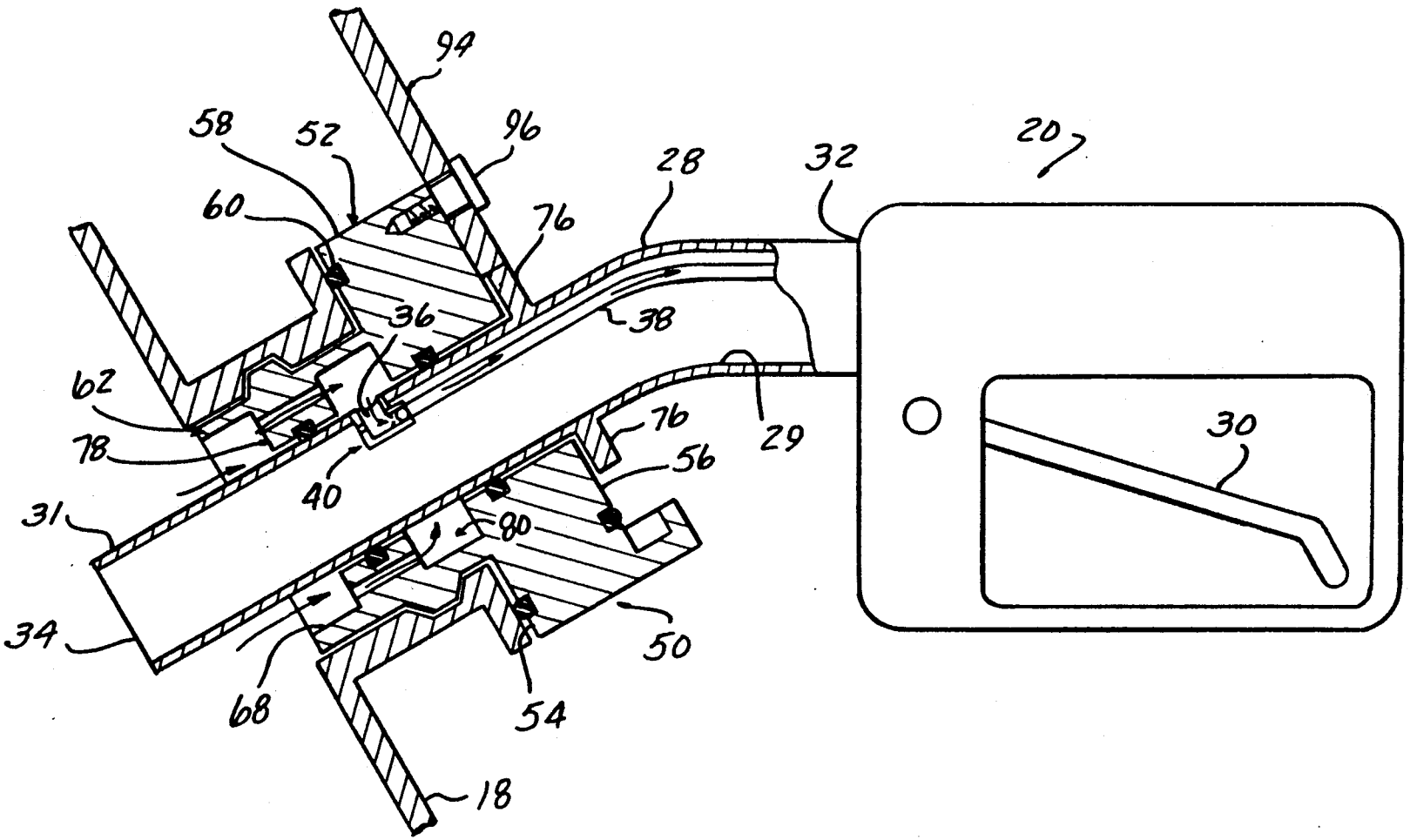
FIG. 2 is a partial cross-sectional view of a first embodiment of the fuel filler cap and details of the fuel filler nozzle device of the self-contained fuel filler system of the present invention.

The fuel filler nozzle device 20 has a fuel directing conduit 28 as well as suitable means for regulating and interrupting fuel flow through the fuel directing conduit 28. As depicted in FIGS. 1 and 2, the regulating and interrupting means may be a conventional trigger mechanism 30 equipped with suitable shut-off valves and the like such as that employed on conventional gasoline nozzle dispensers.

The fuel directing conduit 28 of the filler nozzle device 20 of the present invention is a hollow conduit composed of any suitable sturdy fuel resistant material. The hollow conduit is defined by a cylindrical wall 29 having a first fuel-receiving end 32 proximate to the regulating and interrupting means and a second fuel dispensing end 34 opposed thereto. The hollow conduit is configured to induce fluid flow of the fuel therethrough in an efficient, preferably non-turbulent manner. Preferably, the fuel flows through the hollow conduit in a direction essentially parallel to the longitudinal axis of the conduit.

The fuel directing nozzle 28 may have any contours throughout its length which would increase its ease of insertion into the fuel filler line 18 of the automotive vehicle 16 to be refueled. Any bend or contour present in the fuel directing conduit 28 is generally such that it will not unduly restrict or impede the delivery of fuel into the on-board fuel storage tank of the automotive vehicle 16.

The fuel inlet end of the flexible fuel hose 22 is in communication with suitable pumping and metering means 24 such as those schematically depicted in FIG. 1. It is anticipated that such pumping and metering means may be any of those currently employed to dispense liquid fuel to automotive vehicles. Such pumping and metering systems can include stationary systems such as those currently employed in commercial service stations as well as movable tanks such as would be employed to dispense fuel to off-road construction equipment and the like. It is to be understood that the self-contained fuel dispensing system of the present invention is most advantageously employed in conjunction with fuel dispensing stations adapted to provide the limited quantities of fuel to automotive vehicles. By the term "limited quantities of fuel", it is meant that the system is most advantageously employed to dispense quantities of liquid fuel below approximately fifty to one hundred gallons per refueling. Such quantities generally encompass the refueling needs for most automotive vehicles, particularly those owned and driven by private consumers. These requirements generally entail the dispensing of measured or smaller quantities of fuel through relatively constricted openings which are generally not amenable to the liquid transfer techniques which would be employed with large volume transfer operations.

The fuel directing conduit 28 of the fuel filler nozzle device 20 of the present invention also includes a vapor receiving inlet 36 located in the cylindrical wall 29 at a position between the first fuel inlet end 32 and the second fuel outlet end 34. The vapor receiving inlet 36 extends through the cylindrical wall 29 into the interior area defined therein. The vapor receiving inlet 36 permits fluid communication between the exterior of the fuel directing conduit 28 and a vapor conveying line 38 located within the interior of the fuel directing conduit 28 which will be described in greater detail subsequently.

Figure 4:
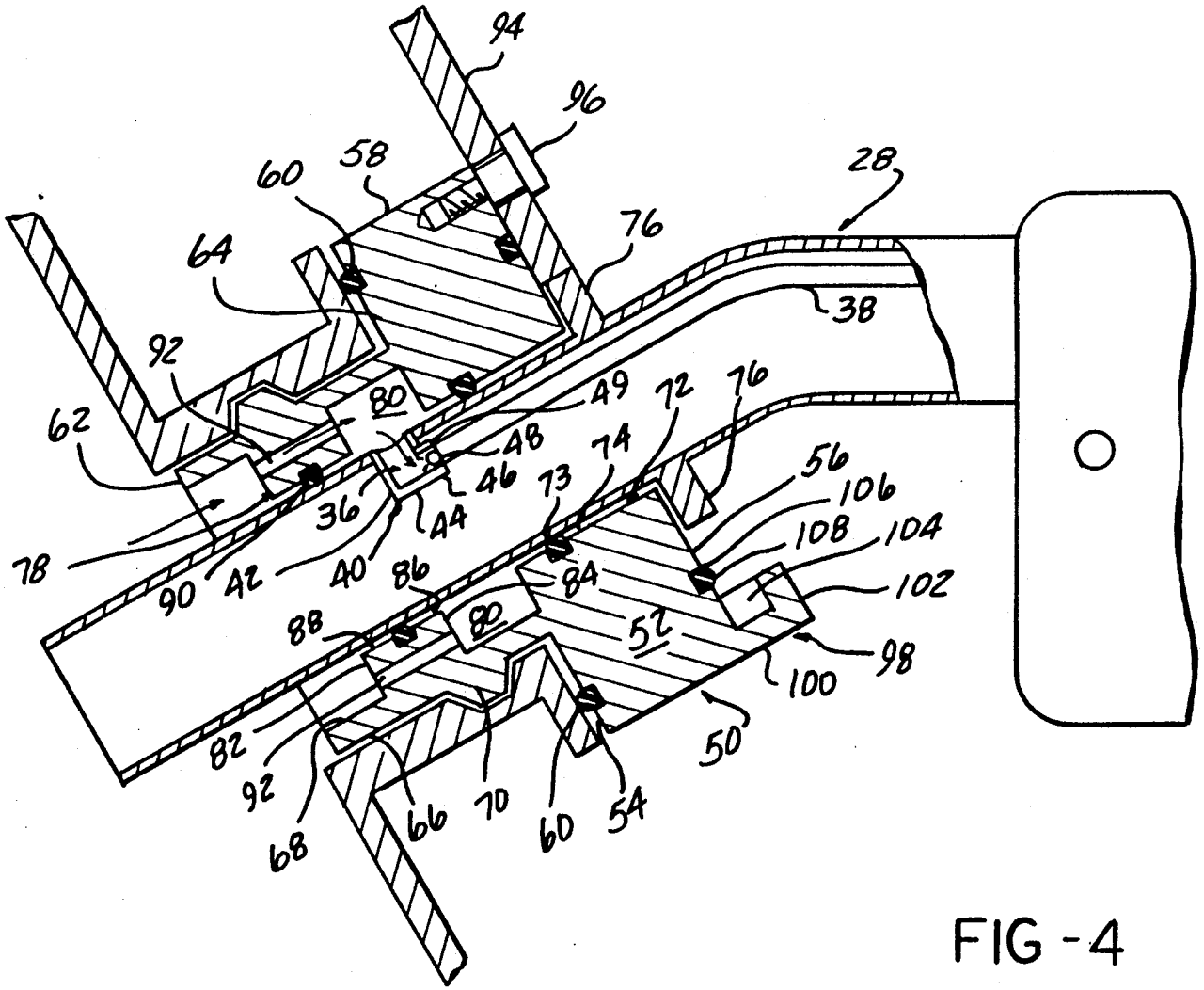
FIG. 4 is a cross-sectional view of a detail of FIG. 2.

The vapor receiving inlet 36 may communicate directly with the vapor conveying line 38 or may communicate with a suitable detent 40 such as that shown in FIG. 2 and depicted in greater detail in FIG. 4. The detent 40 projects inwardly toward the center of the fuel directing nozzle 28 to a distance sufficient to permit attachment of the vapor conveying line 38 directly thereto. Preferably detent 40 is positioned on the fuel directing nozzle 28 at a position which minimizes induction of turbulence in the fuel flowing through the nozzle 28. Furthermore, the inward projection of detent 40 is also maintained at a minimum to further decrease induction of fluid turbulence from that quarter.

The detent 40 is, preferably, a cylindrical conduit having a first leg 42 and a second leg 44 oriented angularly therewith. In the preferred embodiment, the first leg 42 is in fluid communication with the vapor receiving inlet 36 located in the fuel directing conduit 28. The first leg 42 of the detent 40 is preferably oriented at an angle which is essentially perpendicular to the fluid flow path of fuel passing through the interior of the fuel directing conduit however other variations on this angular orientation are possible.

The second leg 44 of the detent 40 is contiguously joined to the first leg at a suitable angle thereto. In the preferred embodiment, the second leg 44 extends perpendicularly outward from the first leg 42 and terminates in a vapor outlet opening 46 which is in fluid communication with the vapor conveying line 38. The second leg 44 of the detent 40 can include means for preventing uncontrolled backflow of vapors from the vapor conveying line 38 such as the pressure activated check valve 48 located proximate to the vapor outlet opening 46. The second leg 44 may also include suitable hose mounting flanges or the like necessary to provide stable connection between the vapor conveying line 38 and the detent 40.

The first and second legs 42,44, respectively of detent 40 may be oriented in any direction relative to the fuel directing conduit 28. The orientation of detent 40 is generally one which will permit easy conveyance of fuel vapors away from the fuel filler line 18 of the automobile 16 and through the vapor conveying line 38. In the preferred embodiment as shown in FIGS. 2, 3, 4 and 5, the vapor outlet opening is oriented toward the oncoming fuel being dispensed through the fuel directing nozzle 28.

The vapor conveying line 38 has a vapor inlet end 49 which overlays the outer surface of the vapor outlet 46 of the detent 40 and terminates in an opposed vapor outlet (not shown) in fluid communication with a suitable means for collecting vapors remote from the automotive vehicle 16 which will be described in greater detail subsequently. The vapor conveying line 38 preferably is positioned adjacent to the interior of the cylindrical wall 29 of the fuel conveying nozzle 28 and passes through the remainder of the fuel filler nozzle device 20 and the flexible fuel hose 22. The vapor conveying line 38 may pass through the means for interrupting the fuel flow into the fuel directing conduit 28 or may be opened and closed in concert with the fuel interrupting means.

The vapor conveying line 38 may pass through the fuel pump 24 or may separate from the flexible fuel hose at any suitable location. If the vapor conveying line 38 diverges from the flexible fuel hose 22, it is anticipated that the vapor conveying line may include suitable pumps, concentrators and the like in fluid communication with the line 38 to enhance passage of the fuel vapor therethrough and to possibly reclaim fuel vapor into useful fuel. If desired, the vapor conveying line 38 can terminate in the remote fuel storage site 12.

Figure 3:
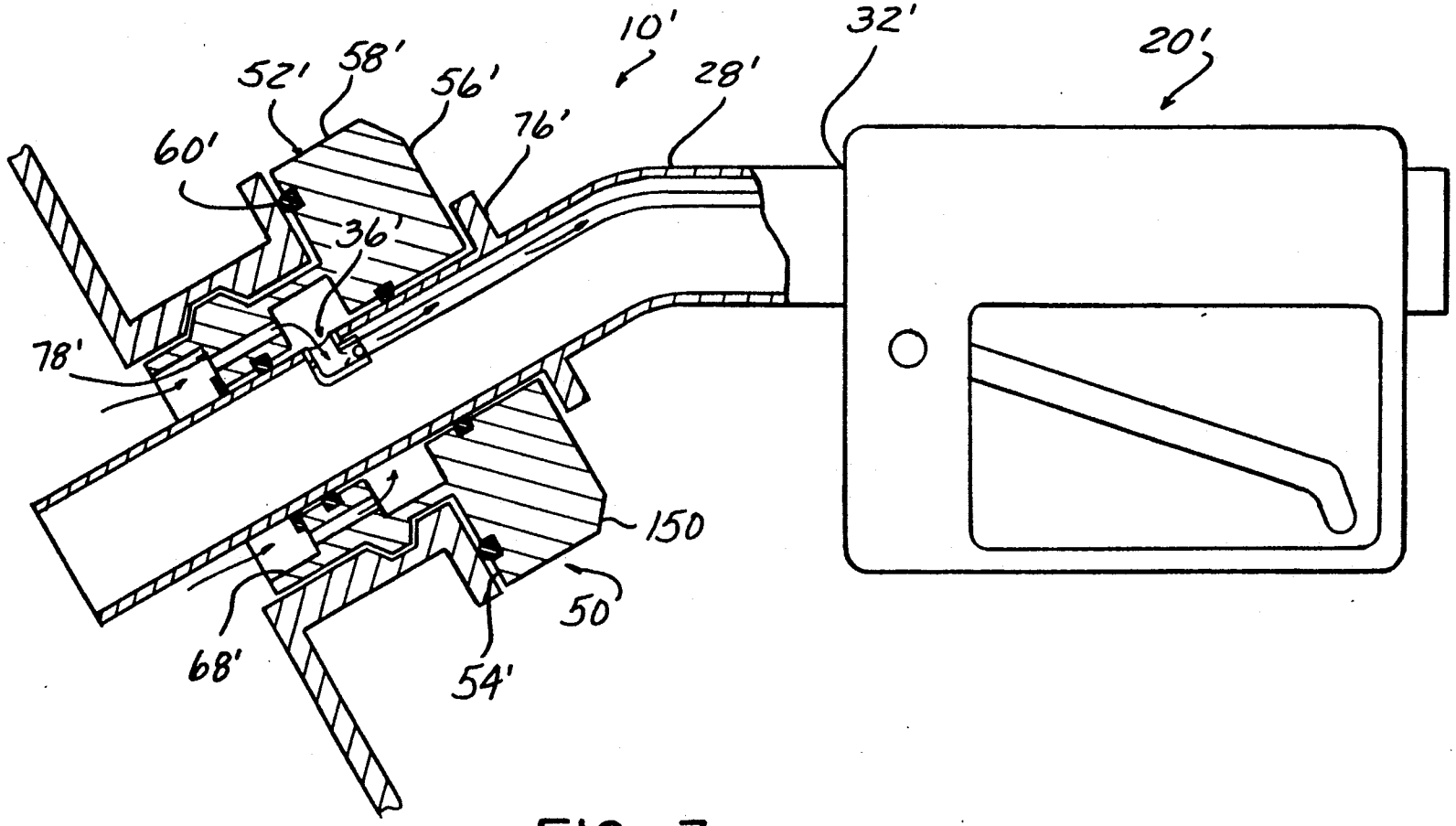
FIG. 3 is a partial cross-sectional view of a second embodiment of the fuel filler cap and details of the fuel filler nozzle device of the self-contained fuel filler system of the present invention.
Figure 5:
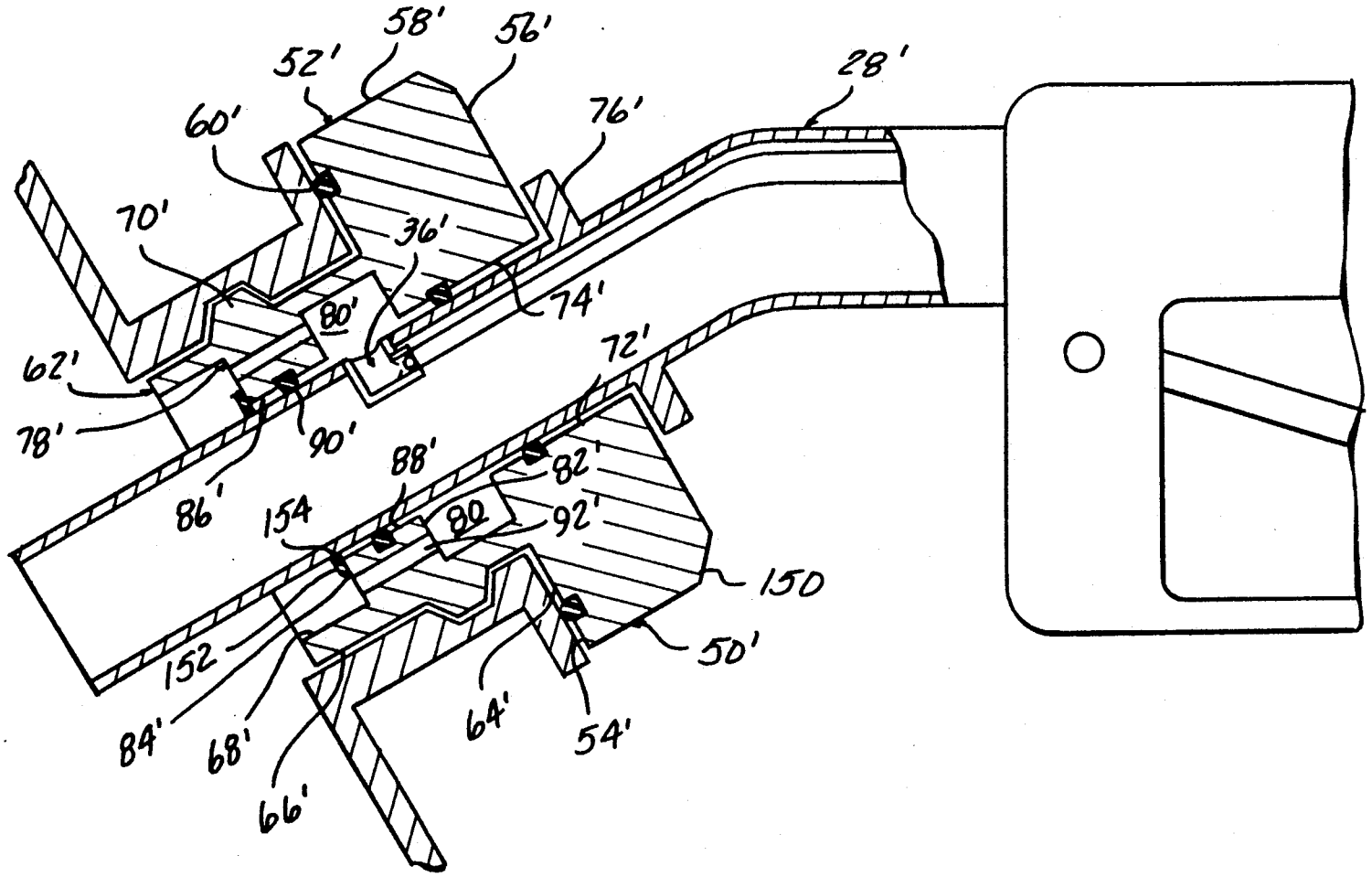
FIG. 5 is a cross-sectional view of a detail of FIG. 3.

The fuel filler nozzle device 20 is adapted to be insertingly received in the suitably configured fuel filler cap 50 of the present invention which is threadingly received in the outer opening of the fuel filler line 18 of the automotive vehicle 16. In the first embodiment of the present invention, as shown in FIGS. 2 and 4, the fuel filler nozzle device 20 can be releasingly inserted into the fuel filler cap 50 while the cap is maintained in threading mating contact with the outer opening of the fuel filler line 18 of the automotive vehicle. In the second embodiment of the present invention, as shown in FIGS. 3 and 5 the fuel filler nozzle device 28′ is permanently attached to the fuel filler cap 50′ in a manner which permits at least partial rotation of the filler cap 50′ around the fuel directing conduit 28′ in a manner which will be described in greater detail subsequently.

In the first embodiment of the present invention, shown in FIGS. 2 and 4, the fuel filler cap 50 can be inserted into the opening 26 of the fuel filler line 18 of the automotive vehicle 16 as a replacement for the conventional fuel filler cap. The discharge conduit of the fuel filler nozzle device 28 is separately insertable in and removable from contact with the fuel filler cap 50 in a manner which will be described subsequently.

The fuel filler cap 50 is composed of an essentially flat planar surface member 52 having an inner face 54 and an outer face 56 and a central aperture 72 extending through from the inner face 54 to the outer face 56. The flat planar member 52 may have any suitable configuration for its outer perimeter. In the preferred embodiment, the flat planar member 52 has an essentially circular outer circumference sufficient to permit the inner face 54 to engage and overlay the fuel receiving inlet 26 of the fuel filler line 18 of the automotive vehicle 16. The flat planar member 52 has a side surface 58 contiguous with and essentially perpendicular to the outer face 56 and the inner face 54. The side surface 58 may have a plurality of spaced ridges or grooves (not shown), located therein to assist in removal of the filler cap 50 as necessary.

The filler cap 50 of the present invention also, preferably, includes suitable sealing means, which may be located on the inner face 54 to effect a vapor-tight seal connecting the fuel filler line 18 and the fuel filler cap 50 when the filler cap 50 is brought into engagement therewith. In the preferred embodiment, the filler cap 50 has a gasket 60 mounted on the inner face 54 which can deformably engage a mating region of either the fuel filler line 18 or associated body surface of the automotive vehicle 16 to provide a seal therebetween.

The filler cap 50 of the present invention also includes means for maintaining the cap 50 in engagement with the fuel filler line 18 of the automotive vehicle 16. In the first embodiment of the present invention, the fuel filler cap 50 includes an essentially cylindrical projection 62 mounted to and extending perpendicularly outward from the inner face 54 of the flat planar member 52. The cylindrical projection 62 is, preferably, positioned essentially coaxially interior to the periphery of the flat planar member 52 thereby defining a region 64 in the inner face 54 of the flat planar member 52 which is exterior to the cylindrical projection 62 in which the annular flange 60 is located. In the preferred embodiment, the exterior region 64 of the flat planar member 52 is in overlying sealing relationship to the automotive vehicle 16 or an appendage thereon proximate to the fuel filler line 18 when the filler cap 50 is sealingly engaged in the fuel filler line 18.

The cylindrical projection 62 has an outer surface 66 contiguous with the exterior region 64 of the flat planar member 52 and an opposed inner surface 68. At least a portion of the outer surface 66 is defined by a threaded region 70 which is adapted to be received in a matingly threaded region located on the interior surface of the fuel filler line 18.

The cylindrical projection 62, preferably, has a standard diameter to enable the filler cap 50 of the present invention to permit ready replacement of the original equipment fuel filler cap with which the automotive vehicle 16 equipped with the fuel filler cap of the present invention. It can be appreciated that threaded engagement between the fuel filler cap 50 of the present invention and the fuel filler line 18 of the automotive vehicle 16 permits ready removal of the fuel filler cap 50 in the event that refueling is necessary at a refueling station which is not equipped with the compatible portion of the emission abatement device 10 of the present invention.

The fuel filler cap 50 of the present invention includes a central aperture 72 extending through the flat planar member 52 from the outer face 56 to the inner face 54 in an essentially perpendicular manner. The central aperture 72 is, preferably, cylindrical and is defined by an inner surface 74. The central aperture 72 is coaxially positioned relative to both the flat planar member 52 and the cylindrical projection 62 to permit insertion of the fuel directing conduit 28 of the fuel directing nozzle 20 through the aperture and the cylindrical projection and into the fuel filler line 18 of the automotive vehicle 16.

In order to maintain an essentially vapor tight relationship between the fuel directing conduit 28 and the fuel filler cap 50, the fuel filler cap 50 can include suitable means for establishing a seal between these two components. As shown in FIG. 4, the fuel filler cap includes a sealing ring 73 positioned on the inner surface 74 of the central aperture 72.

The vapor receiving inlet 36, also shown in FIG. 4 which is present in the fuel directing conduit 28 of the fuel dispensing nozzle device 20 is positioned so that the inlet 36 is located below the inner face 54 of the flat planar member 52 in fluid contact with an interior vapor collection area defined by the inner surface 68 of the cylindrical member 62. In order to accurately position the vapor receiving inlet 36 relative to the flat planar member 52, the fuel dispensing nozzle device 20 may include suitable means for positioning the fuel directing conduit 28 in the central aperture 72. As depicted in FIG. 2, the positioning means can include an annular collar 76 extending perpendicularly outward from the outer surface of the fuel directing conduit 28 at a position intermediate between the vapor receiving inlet 36 and the fuel receiving inlet 32.

The fuel filler cap 50 of the present invention may also include a suitable means for guiding the fuel directing conduit 28 relative to the interior of the cylindrical projection 62 and for maintaining the fuel directing device in optimum position relative to the fuel filler cap 50. As depicted in FIG. 2, the guiding means is a central guide 78 mounted on and extending inward from the interior wall of the cylindrical projection 62. The central guide may be located at any position in the interior of the cylindrical projection which will permit the definition of a vapor collection chamber 80 proximate to and in fluid communication with the vapor receiving aperture 36 located on the fuel directing conduit 28. In the preferred embodiment, the central guide 78 is located at a position essentially midway between the junction point of the cylindrical projection 62 with the flat planar member 52 and the lower outlet of the cylindrical member.

The central guide 78 is a cylindrical member contiguous with and projecting annularly inward from the inner surface of the cylindrical projection 62. As depicted in FIG. 4, the central guide 78 has opposed inner and outer faces 82, 84, respectively which are essentially parallel to one another and are positioned essentially perpendicular to the contiguous inner surface of the cylindrical projection 62. A central throughbore 86 extends through the central guide 78 from the inner face 82 to the outer face 84 to form a hollow shaft with an inner cylindrical surface 88 through which the fuel directing conduit 28 can be inserted. In order to appropriately direct fuel vapor to the fuel receiving aperture 36 and to prevent any seepage of liquid fuel into the fuel receiving aperture, the central guide 78 may include suitable means for effecting an essentially vapor-tight seal between the central throughbore 86 of the central guide 78 and the outer surface of the fuel directing conduit. The sealing means is an annular sealing flange 90 positioned in an annular groove located in the inner cylindrical surface 88 of the throughbore 86.

In order to permit the movement of fuel vapors created or displaced during the refueling operation away from the on-board storage tank and into the vapor receiving aperture 36, the central guide 78 can also include at least one vapor conveying aperture 92 extending from the outer face 84 of the central guide 78 through to the inner face 82 to establish fluid communication with the vapor collection chamber 80. The vapor conveying aperture 92 is located in the central guide 78 at a position between the central shaft 86 and the inner surface of the cylindrical projection 78. The vapor conveying aperture 92 may have any suitable cross-sectional configuration which will permit the ready egress of fuel vapors to the vapor receiving aperture 36.

In the embodiment shown in FIG. 2, the fuel filler cap 50 functions as a replacement for a conventional fuel filler cap. The fuel filler cap 50 of the present invention also includes means for effecting sealing closure of the central aperture 72 between refueling operations when the fuel directing conduit 28 is not matingly inserted therein. The sealing means can include a variety of closure devices such as the one depicted in FIG. 2.

The sealing and closure means set forth in FIG. 2 includes a lid 94 movably mounted on the outer face 56 of the flat planar member 52. The lid 94 is movable between a first closed position in which the lid 94 is in a position overlying the central aperture 72 and an open position in which the lid 94 is removed from the overlying relationship. In the preferred embodiment, the means for mounting lid 94 includes a spring loaded pivot 96 located at a position proximate to the outer periphery of the outer surface 56 of the flat planar member 52.

The lid 94 is preferably an essentially circular or ovoid configuration and is connected to the spring loaded pivot 96 at a point proximate to the outer periphery of lid 94 to effect eccentric rotational movement around the pivot mounting point relative to the flat planar member 52 of the fuel filler cap 50 between a first position overlying the central aperture 72 and a second position distant therefrom.

The cap 92 may be maintained in a secure position overlying the central aperture 72 by any suitable clamp or other securing means. As depicted in FIG. 4, the lid securing means is a cap guide 98 which includes a first leg 100 contiguously attached to and extending essentially upward from the outer surface 56 of the flat planar member 52 proximate to the side wall 58 at a location thereon which is essentially opposed to the position of the spring-loaded pivot 96. The first leg 100, preferably has an arcuate contour conforming to the contour of the side wall 48 of the flat planar member 52. The second leg 102 is contiguously attached to the first leg 100 perpendicularly thereto and extends inwardly therefrom to a channel 104 into which the outer edge of the lid 94 can be releasably received. The first leg 100 extends from outward the flat planar member and has a height sufficient to permit receipt of the outer edge of the lid 94 into the channel 104 thus formed. The height of the first leg 102 may decrease slightly over its length for the initial opening to the stop to draw the inner surface of the lid 94 into close contact with the outer surface 56 of the flat planar member 52. In order to accomplish an essentially vapor-tight seal between the lid 94 and the flat planar member 52, the fuel filler cap 50 can include suitable means for accomplishing sealing contact between the lid 94 and the outer surface 56. As depicted in FIG. 4, the sealing means includes an annular groove 106 with an O-ring 108 positioned therein.

While the first embodiment of the present invention presents a device which can be employed as a permanent replacement for the conventional filler cap and can be employed with a suitably configured fuel filler device to permit the dispensation of fuel into an on-board fuel storage tank of an automotive vehicle with reduced fuel vapor discharge, the second embodiment depicted in FIG. 3 and FIG. 5, presents a device in which the fuel filler cap and fuel filler nozzle device are an integral unit which can be inserted into the fuel filler line of an automotive vehicle after removal of the conventional fuel filler cap. Upon completion of the refueling operation, the integral device of the second embodiment can be removed and the conventional fuel filler cap replaced.

The second embodiment of the present invention as depicted in FIG. 3 includes a fuel filler nozzle device 20' which is essentially similar to that previously described in connection with FIG. 2 having a fuel filler cap 50' rotatingly mounted thereon in an essentially permanent manner.

As in the first embodiment, the fuel filler cap 50' of the second embodiment of the present invention includes a flat planar member 52' having an inner face 54' and an opposed outer face 56' and a central aperture 72' extending through from the inner face 54' to the outer face 56'.

The flat planar member 50' may have any suitable configuration for its outer perimeter. It is preferred that the flat planar member 50' have an essentially circular outer circumference sufficient to permit the inner face 54' to engage and overlay the fuel receiving inlet of the fuel filler line 18 of the automotive vehicle 16 in the manner previously described. The flat planar member 52' has a side surface 58' contiguous with and essentially perpendicular to the outer face 56' which extends between the two faces 54', 56'. The side surface 58' may have a plurality of spaced ridges or grooves (not shown), located therein to assist in removal of the filler cap 50' as necessary. If desired, the flat planar member 52' can also include an angled or routed edge 150 extending between the side surface 58' and the outer face 56' which will facilitate insertion and removal of the fuel filler cap portion of the device of the present invention from engagement with the fuel filler line 18 of the automotive vehicle 16.

In order to effect sealing engagement between the fuel filler cap 50' and the fuel filler line 18 of the automotive vehicle 16 and between the fuel directing conduit 28' and the fuel filler cap 50', the filler device of the second embodiment of the present invention can be equipped with suitable sealing means such as those previously described in conjunction with the device set forth in FIG. 2.

The fuel filler cap 50' of the second embodiment further includes means for maintaining the cap 50' in engagement with the fuel filler line 18 of the automotive vehicle 16 during refueling operations. In the first embodiment of the present invention, the fuel filler cap 50' includes an essentially cylindrical projection 62' mounted to and extending perpendicularly outward from the inner face 54' of the flat planar member 52'. The cylindrical projection 62' is, preferably, positioned essentially coaxially interior to the periphery of the flat planar member 50' thereby defining a region 64' of the inner face 54' of the flat planar member 52' which is exterior to the cylindrical projection 62' in which the annular flange 60' is located. In the preferred embodiment, the exterior region 64' of the flat planar member 52' is in overlying sealing relationship to the automotive vehicle 16 proximate to the fuel filler line 18 when the filler cap 50' is sealingly engaged in the fuel filler line 18.

The cylindrical projection 62' has an outer surface 66' contiguous with the exterior region 64' of the flat planar member 52' and an opposed inner surface 68'. At least a portion of the outer surface 66' is defined by a threaded region 70' which is adapted to be received in a matingly threaded region located on the interior surface of the fuel filler line 18.

The cylindrical projection 62', preferably, has a standard diameter to enable the filler cap 50' of the present invention to readily replace the original equipment fuel filler cap with which the automotive vehicle 16 previously employed thereon. It can be appreciated that threaded engagement between the fuel filler cap 50' of the present invention and the fuel filler line 18 of the automotive vehicle 16 permits ready positioning and removal of the fuel filler cap 50' before and after refueling operations.

The fuel filler cap 50' of the present invention includes a central aperture 72' extending through the flat planar member 52' from the outer face 56' to the inner face 54' in an essentially perpendicular manner. The central aperture 72' is, preferably, cylindrical and is defined by an inner surface 74'. The central aperture 72' is coaxially positioned relative to both the flat planar member 52' and the cylindrical projection 62' to permit insertion of the fuel directing conduit 28' of the fuel directing nozzle 20' through the aperture and the cylindrical projection into the fuel filler line 18 of the automotive vehicle 16.

As shown in FIG. 3, the vapor receiving inlet 36' present in the fuel directing conduit 28' of the fuel dispensing nozzle device 20' is positioned so that the inlet 36' is located below the inner face 54' of the flat planar member 52' in fluid contact with an interior vapor collection area defined by the inner surface 68' of the cylindrical member 62'.

The fuel filler cap 50' of the present invention may also include a suitable means for maintaining the fuel directing conduit 28' in position relative to the interior of the cylindrical projection 62' of the fuel filler cap 50'. As depicted in FIG. 3, the position retaining means is a central guide 78' mounted on and extending inward from the interior wall of the cylindrical projection 62'. The central guide may be located at any position in the interior of the cylindrical projection 62' which will permit the definition of a vapor collection chamber 80' proximate to and in fluid communication with the vapor receiving aperture 36' located on the fuel directing conduit 28' In the preferred embodiment, the central guide 78' is located at a position essentially midway between the junction point of the cylindrical projection 62' with the flat planar member 52' and the lower outlet of the cylindrical member.

The central guide 78' is a cylindrical member contiguous with and projecting annularly inward from the inner surface of the cylindrical projection 62'. As depicted in FIG. 5, the central guide 78' has opposed inner and outer faces 82', 84', respectively, which are essentially parallel to one another and are positioned essentially perpendicular to the contiguous inner surface of the cylindrical projection 62'. A central throughbore 86' extends through the central guide 78' from the inner face 82' to the outer face 84' to form a hollow shaft with an inner cylindrical surface 88, through which the fuel directing conduit 28' projects In order to appropriately direct fuel vapor to the fuel receiving aperture 36' and to prevent any seepage of liquid fuel into the fuel receiving aperture, the central guide may include suitable means for effecting an essentially vapor-tight seal between the central throughbore 86' of the central guide 78' and the outer surface of the fuel directing conduit. The sealing means as depicted in FIG. 3 is an annular flange 90' positioned in an annular groove located in the inner cylindrical surface 88'of the throughbore 86'.

In order to permit the movement of fuel vapors created or displaced during the refueling operation away from the on-board storage tank and into the vapor receiving aperture 36', the central guide 78' can also include at least one vapor conveying shaft 92' extending from the outer face 84' of the central guide 78' through to the inner face 82' to establish fluid communication with the vapor collection chamber 80'. The vapor conveying shaft 92' is located in the central guide at a position between the central shaft 86' and the inner surface of the cylindrical projection 78'. The vapor conveying shaft 92' may have any suitable cross-sectional configuration which will permit the ready egress of fuel vapors to the vapor receiving aperture 36'.

In order to maintain the fuel directing conduit 28' in contact with fuel filler cap 50' and to accurately position the vapor receiving inlet 36' relative to the flat planar member 52', the fuel dispensing nozzle device 20' may include suitable means for positioning the fuel directing conduit 28' in the central aperture 72'. As depicted in FIG. 3, the positioning means can include an annular collar 76' extending perpendicularly outward from the outer surface of the fuel directing conduit 28' at a position intermediate between the vapor receiving inlet As depicted in FIG. 5, a circular retaining ring 152 or other suitable retention means can be pressure fit over the fuel directing conduit 28' at a position opposed to the annular collar 72' and in contact with the lower face 84' of the central guide 78' to retain the fuel filler cap 50' in contact with the fuel directing conduit 28'. The retaining ring 152 can be maintained in position by any suitable device such as friction or can be snap fit into a suitable groove 154 in the outer surface of the fuel directing member 28'. The position of the retaining ring 152 relative to the annular collar 72' is such that at least partial rotational movement of the fuel filler cap 50' relative to the fuel directing conduit 28' is possible. The degree of rotation is that sufficient to permit threading insertion of the fuel filler cap 50' into engagement with the fuel filler line 18 of the automotive vehicle 16 and disengagement of the fuel filler device 10' once refueling operations are completed.

If desired, the fuel filler cap 50' and mating fuel filler nozzle can be equipped with suitable mating mechanical mechanisms to automatically screw the cap 50' into sealing engagement with the fuel filler opening 18 as the gas introduction lever is pulled to introduce gasoline into the car or tank. When fuel introduction is complete, the level can be disengaged resulting in the automatic rotational disengagement of the fuel filler cap 18.

What is claimed is:

1. An apparatus for introducing volatile fuel into an on-board fuel storage tank of an automotive vehicle, and said apparatus adapting to a conventional automotive vehicle having a fuel filler line, a threaded region along said fuel filler line, and a fuel receiving opening in fluid communication with the on-board fuel storage tank, the volatile fuel introduction occurring with reduced discharge of fuel vapors into the surrounding atmosphere, the apparatus comprising:

means for receiving fuel into the on-board storage tank of the automotive vehicle, the fuel receiving means including a fuel filler cap releasably and sealingly engageable in the fuel receiving opening of the automotive vehicle, the cap having an essentially flat planar surface member oriented in a plane perpendicular to a longitudinal axis of the automotive vehicle fuel filler line when the cap is in sealing engagement therewith, the flat planar surface of the fuel filler cap having an inner face engageable with the inlet in the fuel filler line of the automotive vehicle, an opposed upper face, and a central aperture extending therethrough;

at least one first sealing flange located on the inside diameter of the fuel filler cap defining the central aperture and providing deformable sealing contact between the inside diameter of the fuel filler cap and a fuel filler nozzle device so that upon the insertion of the fuel filler nozzle device into the central aperture, fuel vapors and liquid fuel are prohibited from escaping into the surrounding atmosphere; and means for dispensing fuel from a fuel storage site remote from the automotive vehicle into the on-board fuel storage tank of the automotive vehicle permanently connected to the fuel filler cap, the fuel filler cap being at least partially rotatably therearound, the fuel dispensing means comprising:

a) the fuel filler nozzle device engageable with the fuel receiving opening of the automotive vehicle, the fuel filler nozzle device having a fuel directing conduit receivable within the central aperture extending through the fuel filler cap and means for regulating and interrupting fuel flow therethrough, the fuel directing conduit having a fuel inlet end, an opposed fuel outlet end, and a vapor receiving inlet located in the body of the fuel directing conduit between the fuel inlet and the fuel outlet, the fuel directing conduit further having a vapor conveying line contained within the fuel conveying conduit having a first end and a second end, the first end of the vapor conveying line being in fluid communication with the vapor receiving inlet; and b) means for conveying fuel from the remote storage site to the fuel inlet end of the fuel filler nozzle.

2. The apparatus of claim 1 wherein the removable fuel filler cap further comprises:

engagement means for maintaining the removable fuel filler cap in sealing engagement with the fuel receiving opening of the fuel filler line, the engagement means comprising:

a cylindrical projection having an outer surface and an inner surface, the outer surface having a threaded region covering at least a portion thereof, the threaded region adapted to matingly contact a threaded region located on the fuel filler line, the cylindrical projection extending from the inner surface of the flat planar member perpendicularly outward therefrom at a position essentially coaxially interior of the external circumference of the flat planar member, the major central aperture being located interior to an area defined by the inner surface of the cylindrical projection; and at least one sealing flange located on the inner surface of the flat planar member between the external circumference of the flat planar member and the cylindrical projection and providing deformable sealing contact between the flat planar member and a surface surrounding the filler opening when the filler cap is in mating engagement therewith;

means for retaining the fuel filler nozzle in engagement with the removable fuel filler cap; and means for guiding and positioning the fuel filler nozzle conduit in the central aperture of the fuel filler cap, the fuel filler means comprising a sleeve having an inner surface defining a central fuel filler nozzle receiving shaft and an outer surface coaxially mounted on the inner surface of the cylindrical projection of the fuel filler cap, the sleeve further including at one vapor conveying aperture extending therethrough.

3. The apparatus of claim 2 wherein the guiding and positioning means further comprises means for effecting vapor-tight contact between the outer surface of the fuel filler nozzle and the inner surface of the sleeve.

4. The apparatus of claim 3 further comprising a vapor collection chamber, the vapor collection chamber defined by the inner face of the sleeve, the inner surface of the cylindrical projection, the inner surface of the flat planar member of the fuel filler cap, and the outer surface of the fuel filler nozzle extending through the central aperture, the vapor collection chamber in fluid communication with the vapor receiving inlet located on the fuel filler nozzle.

5. The apparatus of claim 4 wherein the means for retaining the fuel filler nozzle in engagement with the fuel filler cap comprises:

a retaining collar mounted on the outer surface of the fuel filler nozzle between the fuel inlet opening and the vapor receiving inlet and extending annularly outward therefrom, the annular retaining collar having an upper surface oriented toward the inlet opening and an opposed lower surface essentially parallel to the upper surface, the lower surface engageable with the outer surface of the flat planar member of the fuel filler nozzle proximate to the central aperture extending therethrough.

6. The apparatus of claim 5 further comprising:

a cover mounted on the outer surface of the fuel filler cap, the cover movable from a first position overlying the outer surface of the fuel filler cap and a second position removed from contact with the outer surface of the fuel filler cap proximate to the central aperture extending through the flat planar member of the fuel filler cap;

means for maintaining sealing contact between the outer surface of the fuel filler cap and the cover when the cover is in the first position.

7. The apparatus of claim 6 wherein the means for maintaining sealing contact comprises:

an annular flange positioned on the outer surface of the flat planar member;

means for pivotally mounting the cover member on the fuel filler cap, the pivotal mounting means located on the outer surface of the flat planar member proximate to the exterior periphery of the filler cap; and a cover guide and stop member extending upward from the outer surface of the flat planar member and located proximate to the exterior periphery of the filler cap opposed to the pivotal mounting means.

8. The apparatus of claim 4 wherein the means for retaining the fuel filler nozzle in engagement with the fuel filler cap comprises:

a retaining collar mounted on the outer surface of the fuel filler nozzle between the fuel inlet opening and the vapor receiving inlet and extending annularly outward therefrom, the annular retaining collar having an upper surface oriented toward the inlet opening and an opposed lower surface essentially parallel to the upper surface, the lower surface engageable with the outer surface of the flat planar member of the fuel filler nozzle proximate to the central aperture extending therethrough; and a retainer ring in contact with the outer surface of the fuel filler nozzle and extending annularly outward therefrom, the annular retainer ring in compressive contact with the fuel filler nozzle guide mounted in the interior of the cylindrical projection.

9. The apparatus of claim 4 further comprising a remote vapor collection facility in fluid communication with the second end of the vapor conveying line.

10. The apparatus of claim 9 wherein the means for preventing the uncontrolled escape of fuel vapors from the fuel tank of an automotive vehicle further comprises:

means for drawing fuel vapors produced during introduction of the fuel into the on-board fuel tank of the automotive vehicle through the vapor-conveying channel in the guide sleeve and the vapor-conveying line located in the fuel filler nozzle into the remote vapor collection facility.

11. The apparatus of claim 9 wherein the remote vapor collection site is located in the remote fuel storage site.

12. An apparatus for introducing volatile fuel into an on-board fuel storage tank of an automotive vehicle, the automotive vehicle having a fuel filler line with a fuel receiving opening, the volatile fuel introduction occurring with reduced discharge of fuel vapors into the surrounding atmosphere, the apparatus comprising:

a fuel filler cap releasably and sealingly engageable in the fuel receiving opening of the automotive vehicle, the fuel filler cap comprising:

an essentially flat planar surface member having an inner member contacting and perpendicularly overlaying the fuel receiving opening and an opposed outer surface, the flat planar surface member having a central aperture extending from the outer surface to the inner surface and having an inside diameter that defines the central aperture that is adapted to permit establishment of fluid communication between the on-board fuel storage tank and a means for dispensing fuel from a remote fuel storage site, the fuel dispensing means having a fuel delivery outlet engageable within the central aperture of the fuel filler cap;

a cylindrical projection having an inner surface and an outer surface, the outer surface having a threaded region covering at least a portion thereof, the threaded surface adapted to matingly contact the threaded region located on the fuel filler line, the cylindrical projection extending from the inner surface of the flat planar member perpendicularly outward therefrom at a position essentially coaxially interior of the exterior circumference of the flat planar member, the central aperture being located interior to an area defined by the inner surface of the cylindrical projection; and at least one first sealing flange located on the inside diameter of the fuel filler cap defining the central aperture and providing deformable sealing contact between the inside diameter of the fuel filler cap and a fuel filler nozzle device so that upon the insertion of the fuel filler nozzle device into the central aperture, fuel vapors and liquid fuel are prohibited from escaping into the surrounding atmosphere.

13. The apparatus of claim 12 wherein the fuel filler cap further comprises:

at least one second sealing flange located on the inner surface of the flat planar member between the external circumference of the flat planar member and the cylindrical projection and providing deformable sealing contact between the flat planar member and a surface surrounding the filler opening when the filler cap is in mating engagement therewith; and means for retaining the fuel dispensing means in engagement with the removable fuel filler cap.

14. The apparatus of claim 13, wherein the means for dispensing fuel from a remote storage site to the on-board storage tank of the automotive vehicle comprises:

a fuel filler nozzle device engageable with the fuel receiving opening of the automotive vehicle, the fuel filler nozzle device having a fuel directing conduit receivable within the central aperture extending through the fuel filler cap and means for regulating and interrupting fuel flow therethrough, the fuel directing conduit having a fuel inlet end, an opposed fuel outlet end, and a vapor receiving inlet located in the body of the fuel directing conduit between the fuel inlet and the fuel outlet, the fuel directing conduit further having a vapor conveying line contained within the fuel conveying conduit having a first end and a second end, the first end of the vapor conveying line being in fluid communication with the vapor receiving inlet; and means for conveying fuel from the remote storage site to the fuel inlet end of the fuel filler nozzle.

15. The apparatus of claim 13, wherein the fuel dispensing means includes a fuel filler nozzle conduit insertable within the central aperture located in the fuel filler cap and the fuel filler cap further comprises:

means for guiding and positioning the fuel filler nozzle conduit in the central aperture of the fuel filler cap, the fuel filler means comprising a sleeve having an inner surface defining a central fuel filler nozzle receiving shaft and an outer surface coaxially mounted on the inner surface of the cylindrical projection of the fuel filler cap, the sleeve further including at least one vapor conveying aperture extending therethrough.

16. The apparatus of claim 15 wherein the means for dispensing fuel from a remote storage site to the on-board storage tank of the automotive vehicle further comprises and means for regulating and interrupting fuel flow through the fuel directing conduit.

17. The apparatus of claim 16 wherein the means for conveying fuel from a remote storage site further comprises:

a fuel conduit having a downstream end in fluid communication with the inlet of the fuel filler nozzle and a second, upstream end in fluid communication with the remote fuel storage site;

means for metering and measuring the volume of fuel introduced into the on-board storage tank of the automotive vehicle, the metering and measuring means located in the fuel conduit;

at least one pump operable on the fuel conduit capable of drawing fuel from the remote storage site and propelling it through the fuel conveying conduit into the on-board storage tank of the automotive vehicle;

a vapor conveying conduit located inside the fuel conveying nozzle having a first end and a second end, the first end in fluid communication with the vapor receiving inlet located on the fuel filler nozzle intermediate between the fuel inlet opening and the fuel outlet opening, the second end in fluid communication with the remote fuel storage site; and means for drawing fuel vapors produced during introduction of the fuel into the on-board fuel tank of the automotive vehicle through the vapor-conveying fitting and vapor-conveying conduit into the remote fuel storage site.

* * * * *

UNITED STATES PATENT AND TRADEMARK OFFICE

CERTIFICATE OF CORRECTION

PATENT NO. : 5,297,595

DATED : March 29, 1994

INVENTOR(S) : Clay Haile and Ram D. Bedi

It is certified that error appears in the above-identified patent and that said Letters Patent is hereby corrected as shown below:

Column 10, line 13, please delete "cap 92" and insert --lid 94--.

Column 16, claim 12, line 37, please delete "exterior" and insert --external--.

Signed and Sealed this

Twentieth Day of September, 1994

Bruce Lehman

*Attest:*

BRUCE LEHMAN

*Attesting Officer*

*Commissioner of Patents and Trademarks*